US007997170B1

(12) United States Patent
Martinez et al.

(10) Patent No.: US 7,997,170 B1
(45) Date of Patent: Aug. 16, 2011

(54) FIREFIGHTER MULTI-TOOL

(75) Inventors: Roberto Martinez, Miami, FL (US); Jose Alberto Gomez, Miami, FL (US)

(73) Assignee: RJ Inventions, Inc., Miami, FL (US)

( * ) Notice: Subject to any disclaimer, the term of this patent is extended or adjusted under 35 U.S.C. 154(b) by 362 days.

(21) Appl. No.: 12/332,972

(22) Filed: Dec. 11, 2008

(51) Int. Cl.
*B25B 7/00* (2006.01)
*B25B 23/16* (2006.01)

(52) U.S. Cl. ..... 81/427.5; 81/177.85; 81/423; 7/128

(58) Field of Classification Search ..... 81/427.5, 81/177.2, 177.4, 177.85, 421–424; 7/125–131, 7/118, 138
See application file for complete search history.

(56) References Cited

U.S. PATENT DOCUMENTS 5,617,597 A * 4/1997 Reitz ..... 7/113
5,664,274 A * 9/1997 Collins ..... 7/129
6,009,582 A 1/2000 Harrison et al.
6,108,845 A * 8/2000 Hung et al. ..... 7/128
6,273,582 B1 8/2001 Taggart et al.
6,481,034 B2 11/2002 Elsener et al.
6,671,913 B2 1/2004 Wozniak
6,862,764 B2 * 3/2005 Ping ..... 7/128
6,983,506 B1 * 1/2006 Brown ..... 7/168
7,373,681 B2 * 5/2008 Elsener ..... 7/118
2002/0120987 A1 9/2002 Wozniak
2007/0186351 A1 8/2007 Linn et al.

* cited by examiner

*Primary Examiner* — D. S Meislin
(74) *Attorney, Agent, or Firm* — Albert Bordas, P.A.

(57) ABSTRACT

A firefighter multi-tool, comprising a head assembly having at least one interchangeable tool head with locking means, a first handle assembly, and a second handle assembly. The first and second handle assemblies house spring-loaded tools within. The at least one interchangeable tool head comprises spring-loaded trauma shears, a bridging head, channel-lock pliers, traditional pliers, an adjustable wrench, needle-nose pliers, a ratchet, and tin snips. A carrying case carries the head assembly having at least one interchangeable tool head with locking means, the first handle assembly, and the second handle assembly. The carrying case comprises a first compartment having a locking mechanism. At least a second compartment mounts upon the first compartment to house the at least one interchangeable tool head.

16 Claims, 4 Drawing Sheets

FIREFIGHTER MULTI-TOOL

BACKGROUND OF THE INVENTION

1. Field of the Invention

The present invention relates to tools, and more particularly, to multi-tools for use by firefighters.

2. Description of the Related Art

Multiple-function tools have been designed in the past. Although combination tools provide a variety of different tools, the user is generally limited specific tools that are available from a given combination tool. However, certain tools, such as the used by firefighters, are not provided in combination tools. Firefighters have to distribute among them a whole bunch of separated tools in different containers, bags and cases for different uses. Sometimes, they need a tool that another firefighter has or it is in the truck, which cause a waste of time in a critic moment.

Applicant believes that one of the closest references corresponds to U.S. Pat. No. 6,009,582 issued to Harrison, et al. on Jan. 4, 2000 for Multiple Function Tool. However, it differs from the present invention because Harrison, et al. teach a compound, multiple-function, foldable tool having first and second handles, a tool head with pivotable jaw members, and a plurality of additional tools. The tool head is stored within first channels on first sides of the handles, and the additional tools are stored within second channels on second sides of the handles, opposite the first sides. Thus, when the tool head is used, the additional tools do not interfere with gripping of the handles during use of the tool head. Moreover, because of the position of the additional tools, these tools are accessible while the tool head is in the storage position. The compound tool may also include a ratchet and an adapter and coupler that fit on the ratchet or at least one of the additional tools so that even further tools may be fit on the compound tool. An easy to read full length, straight edge ruler may optionally be provided on the top and bottom surfaces of the handles. Preferably, an individual spring is provided for each tool to prevent further pivoting of the selected tool away from the storage channels once the tool is extended into a working position. A spring lock mechanism may also be provided to prevent the undesired return of an extended tool into the storage position until the lock is released.

Applicant believes that another reference corresponds to U.S. Pat. No. 6,481,034 issued to Elsener, et al. on Nov. 19, 2002 for Multiple Function Tool. However, it differs from the present invention because Elsener, et al. teach a compound, multiple-function, foldable tool having first and second handles, a tool head with pivotable jaw members, and a plurality of additional tools. The tool head are stored within first channels on first sides of the handles, and the additional tools are stored within second channels on second sides of the handles opposite the first sides. Thus, when the tool head is used, the additional tools do not interfere with gripping of the handles during use of the tool head. Moreover, because of the position of the additional tools, these tools are easily accessible while the tool head is in the storage position. The compound tool may also include a ratchet and an adapter and coupler that fit on the ratchet or at least one of the additional tools so that even further tools may be fit on the compound tool. An easy to read full length, straight edge ruler may optionally be provided on the top and bottom surfaces of the handles. Preferably, an individual spring is provided for each tool to prevent further pivoting of the selected tool away from the storage channels once the tool is extended into a working position. A spring lock mechanism may also be provided to prevent the undesired return of an extended tool into the storage position until the lock is released.

Applicant believes that another reference corresponds to U.S. Pat. No. 6,273,582 issued to Taggart, et al. on Aug. 14, 2001 for Compact Multiple Function Tool. However, it differs from the present invention because Taggart, et al. teach a multiple function combination business travel tool that combines a plurality of individual business-oriented implements in a single compact and reduced configuration for many diverse business-oriented travel needs. The tool includes a flashlight positioned along a scale, or wide side, of the tool such that a light bulb and reflector larger than those provided along the side of prior art tools may be provided. The tool also preferably includes a clock, preferably in the form of a digital alarm clock, and a plurality of deployable implements, preferably selected with the needs of a business traveler in mind. In one embodiment, the tool includes a pair of handles having implement channels and scissor channels, the handles forming the handles of a deployable scissors whose blades are stored in the scissor channels. Deployment of the scissor blades is achieved by rotation thereof about axles by which the blades are respectively coupled to the tool handles, thereby forming scissors with the first and second tool handles functioning as handles of the scissors.

Applicant believes that another reference corresponds to U.S. Pat. No. 6,671,913 issued to Wozniak on Jan. 6, 2004 for Specialized Military and Police Combination Tool. However, it differs from the present invention because Wozniak teaches a tool assembly for military or police having uses with removable interchangeable tool heads and handles. The handles of the tool assembly have connector assemblies at each end of the handle constructed of a cast nylon material impregnated with a dry lubricant and with a dimpled pin connector in the connector assemblies. Each tool head has a bore for receipt of the connector assembly and pin connector. The connector assemblies are constructed of a non-conductive, non-sparking material and the bores on the tool heads for receipt of the connector assemblies are made with close tolerances to provide for overall rigidity and strength of the tool assembly. The handles have a soft, non-conductive, shock absorbing outer covering. The pin connectors on the connector assemblies are oriented with the outer covering of the tool handles to facilitate ease of assembly of the tools in the dark or other adverse conditions.

Applicant believes that another reference corresponds to U.S. Patent Application Publication No. 20070186351, published on Aug. 16, 2007 to Linn, et al. for Multi Function Tool. However, it differs from the present invention because Linn; Eric; et al. teach a mechanism for extending and retracting pliers and the like into the handle. Along with the pliers, the multi-tool may have various other implements including a full-size blade, a driver tool, a can opener, a punch tool and the like. Furthermore, a lighting element, being either an LED or non-LED type mechanism, and either fixed in place or rotatable or flexible about the handle is contemplated.

Applicant believes that another reference corresponds to U.S. Patent Application Publication No. 20020120987, published on Sep. 5, 2002 to Wozniak, Martin J. for Specialized Military and Police Combination Tool. However, it differs from the present invention because Wozniak teaches a tool assembly for military or police uses with removable interchangeable tool heads and handles. The handles of the tool assembly have connector assemblies at each end of the handle constructed of a cast nylon material impregnated with a dry lubricant and with a dimpled pin connector in the connector assemblies. Each tool head has a bore for receipt of the connector assembly and pin connector. The connector assemblies are constructed of a non-conductive, non-sparking material and the bores on the tool heads for receipt of the connector assemblies are made with close tolerances to provide for overall rigidity and strength of the tool assembly. The handles have a soft, non-conductive, shock absorbing outer covering. The pin connectors on the connector assemblies are oriented with the outer covering of the tool handles to facilitate ease of assembly of the tools in the dark or other adverse conditions.

Other patents describing the closest subject matter provide for a number of more or less complicated features that fail to solve the problem in an efficient and economical way.

None of these patents suggest the novel features of the present invention.

SUMMARY OF THE INVENTION

The present invention is a multi-tool, comprising a head assembly having at least one interchangeable tool head with locking means. A first handle assembly has first and second ends, first and second lateral walls, a first interior side, and a first exterior side. The first exterior side defines an oxygen bottle opener at a first predetermined distance from the first end without reaching the second end. The first and second lateral walls each have first and second internal edges. The first and second internal edges define first semicircular notches. The first interior side comprises a first internal channel. The first handle assembly further comprises a first at least one spring-loaded tool that is housed within the first internal channel when in a stored configuration. A second handle assembly has third and fourth ends, third and fourth lateral walls, a second interior side, and a second exterior side. The second exterior side also defines the oxygen bottle opener at a second predetermined distance from the third end without reaching the fourth end. The third and fourth lateral walls each have third and fourth internal edges. The third and fourth edges define second semicircular notches. The second interior side comprises a second internal channel. The second handle assembly further comprises a second at least one spring-loaded tool that is housed within the second internal channel when in a stored configuration.

The first at least one spring-loaded tool comprises a pendulum/swivel key, a half moon key, a T-way key, and a window punch. The first at least one spring-loaded tool are disposed in a parallel and spaced apart relationship with respect to each other and with respect to the first and second lateral walls. A light-emitting diode is internally mounted under the first lateral wall, adjacent to the first end. The light-emitting diode is battery powered and is controlled by a switch. A key ring secured onto the first end.

The second at least one spring-loaded tool comprises an Allen wrench, a knife with serrated edge that has a bottle cap opener, a flat head screwdriver with seat belt/fabric cutter, a Phillips screwdriver, and metal cutting blade. The second at least one spring-loaded tool is disposed in a parallel and spaced apart relationship with respect to each other and with respect to the third and fourth lateral walls. An alternating current detector is internally mounted under the third lateral wall, adjacent to the third end and the second exterior side. A key ring secured onto the third end.

The at least one interchangeable tool head comprises spring-loaded trauma shears, a bridging head, CHANNEL-LOCK PLIERS, traditional pliers, an adjustable wrench, needle-nose pliers, a ratchet, and tin snips. The at least one interchangeable tool head has a first proximal end. The spring-loaded trauma shears, the bridging head, the CHANNEL-LOCK PLIERS, the traditional pliers, the needle-nose pliers, and the tin snips have a second proximal end. The first and second proximal ends are in a substantial H-shape, and each comprises first and second elongated central notches. The first and second handle assemblies comprise first and second internal longitudinal channels defined from the second and fourth ends respectively. The first and second internal longitudinal channels are of cooperative shape and dimensions to receive the first and second proximal ends.

The locking means comprises the first and second elongated central notches each having at least one metallic band with a base at a fifth end and a head at a sixth end. The base is fixed onto the first and second elongated central notches. The at least one metallic band has resilient characteristics to urge the head to be kept apart from each of the first and second elongated central notches, and the head fits into a through hole of the first and second handle assemblies.

The present invention also comprises a carrying case to carry the head assembly having at least one interchangeable tool head with locking means, the first handle assembly, and the second handle assembly. The carrying case comprises a first compartment having a locking mechanism. The locking mechanism comprises a locking lever and first and second guard walls. The locking lever has a spring-loaded pivoting pin that is mounted onto first and second supports, and a locking tip having a tab. The locking mechanism further comprises a leaf spring that exerts an outward force over the first and second handle assemblies. A predetermined force is applied upon the locking lever to release the locking tip from the first and second handle assemblies. At least a second compartment mounts upon the first compartment to house the at least one interchangeable tool head.

It is therefore one of the main objects of the present invention to provide a firefighter multi-tool that comprises tools utilized by firefighters and/or for emergency use within a same assembly.

It is another object of this invention to provide a firefighter multi-tool that can be readily assembled and disassembled without the need of any special tools.

It is another object of this invention to provide a firefighter multi-tool that comprises a carrying case with capacity to carry the multi-tool as well as a head assembly.

It is another object of this invention to provide a firefighter multi-tool that can be assembled in multiple configurations depending on needs of a user.

It is another object of this invention to provide a firefighter multi-tool that is volumetrically efficient for carrying, transporting, and storage.

It is yet another object of this invention to provide such a multi-tool that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
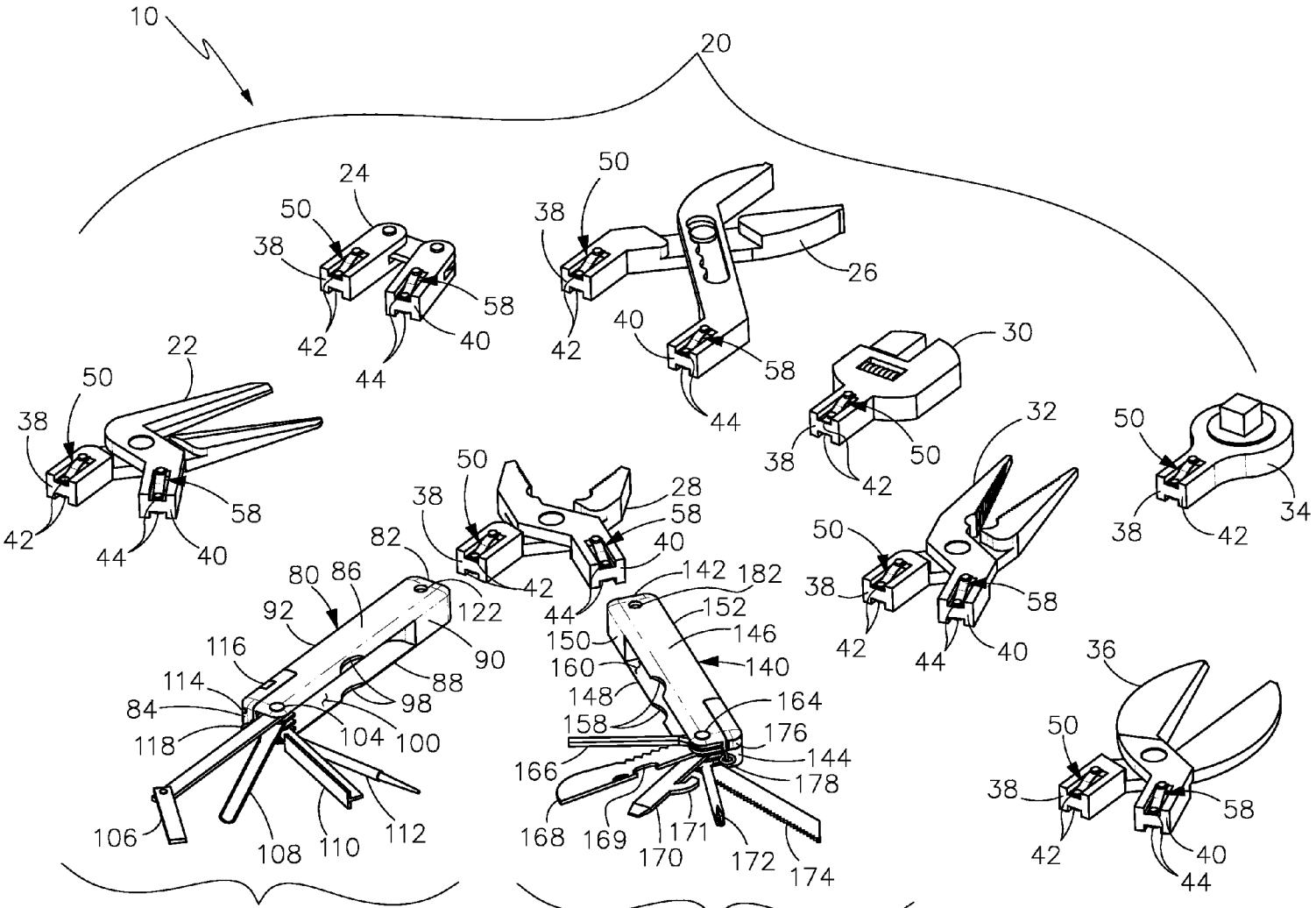
FIG. 1 is an isometric view of the present invention.

Referring now to the drawings, the present invention is generally referred to with numeral 10. It can be observed that it basically includes head assembly 20, handle assemblies 80 and 140, and carrying case 200.

As seen in FIG. 1, head assembly 20 comprises various interchangeable tool heads utilized by firefighters while performing services and duties. Head assembly 20 may include, but is not limited to, spring-loaded trauma shears 22, bridging head 24, CHANNEL-LOCK PLIERS 26, traditional pliers 28, adjustable wrench 30, needle-nose pliers 32, ratchet 34, and tin snips 36. Each interchangeable tool head of head assembly 20 has at least proximal end 38, and most also have proximal end 40. Proximal ends 38 and 40 are in a substantial H-shape, and comprise elongated central notches 42 and 44 respectively.

Figure 3:
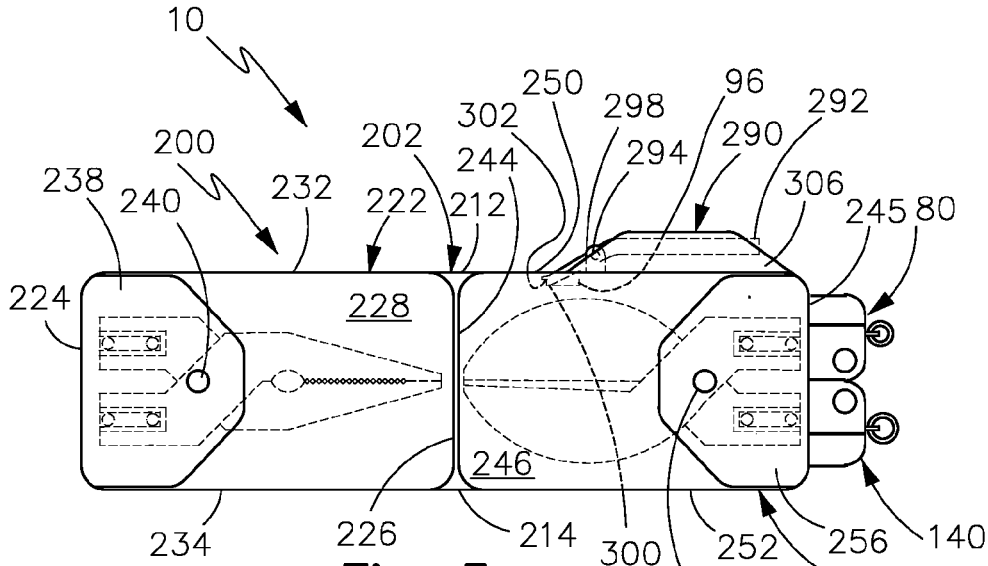
FIG. 3 is a front elevation view of a carrying case to carry the present invention.

Locking mechanisms 50 and 58, as first locking means, secure proximal ends 38 and 40 of each interchangeable tool head defined above to handle assemblies 80 and 140. Handle assembly 80 comprises ends 82 and 84, lateral walls 86 and 88, interior side 90, and exterior side 92. A ruler may be marked upon lateral walls 86 and/or 88. Oxygen bottle opener 96, best seen in FIG. 3, is defined at exterior side 92 at a predetermined distance from end 82 without reach end 84. Semicircular notches 98 are defined at internal edges of lateral walls 86 and 88. Interior side 90 comprises internal channel 100. Handle assembly 80 further comprises spring-loaded tools 102 that pivot at pin 104 adjacent to a corner of end 84. Spring-loaded tools 102 include, but are not limited to, pendulum/swivel key 106, half moon key 108, T-way key 110, and window punch 112. Spring-loaded tools 102 are disposed in a parallel and spaced apart relationship with respect to each other and with respect to lateral walls 86 and 88. Spring-loaded tools 102 are pivotally housed within internal channel 100 when in a stored configuration. Led, light-emitting diode, light 114 is internally mounted under lateral wall 86, adjacent to end 84. Led light 114 is battery powered and is controlled by switch 116. Key ring 118 is secured onto end 84.

Handle assembly 140 comprises ends 142 and 144, lateral walls 146 and 148, interior side 150, and exterior side 152. A ruler may be marked upon exterior edges of lateral walls 146 and/or 148. Oxygen bottle opener 96, best seen in FIG. 3, is defined at exterior side 152 at a predetermined distance from end 142 without reach end 144. Semicircular notches 158 are defined at internal edges of lateral walls 146 and 148. Interior side 150 comprises internal channel 160. Handle assembly 140 further comprises spring-loaded tools 162 that pivot at pin 164 adjacent to a corner of end 144. Spring-loaded tools 162 include, but are not limited to, Allen wrench 166, knife with serrated edge 168 that has bottle cap opener 169, flat head screw driver 170 with seat belt/fabric cutter 171, Phillips screw driver 172, and metal cutting blade 174. Spring-loaded tools 162 are disposed in a parallel and spaced apart relationship with respect to each other and with respect to lateral walls 146 and 148. Spring-loaded tools 162 are pivotally housed within internal channel 160 when in a stored configuration. Alternating current detector 176 is internally mounted under lateral wall 146, adjacent to end 144 and exterior side 152. Key ring 178 is secured at end 144.

Figure 2:
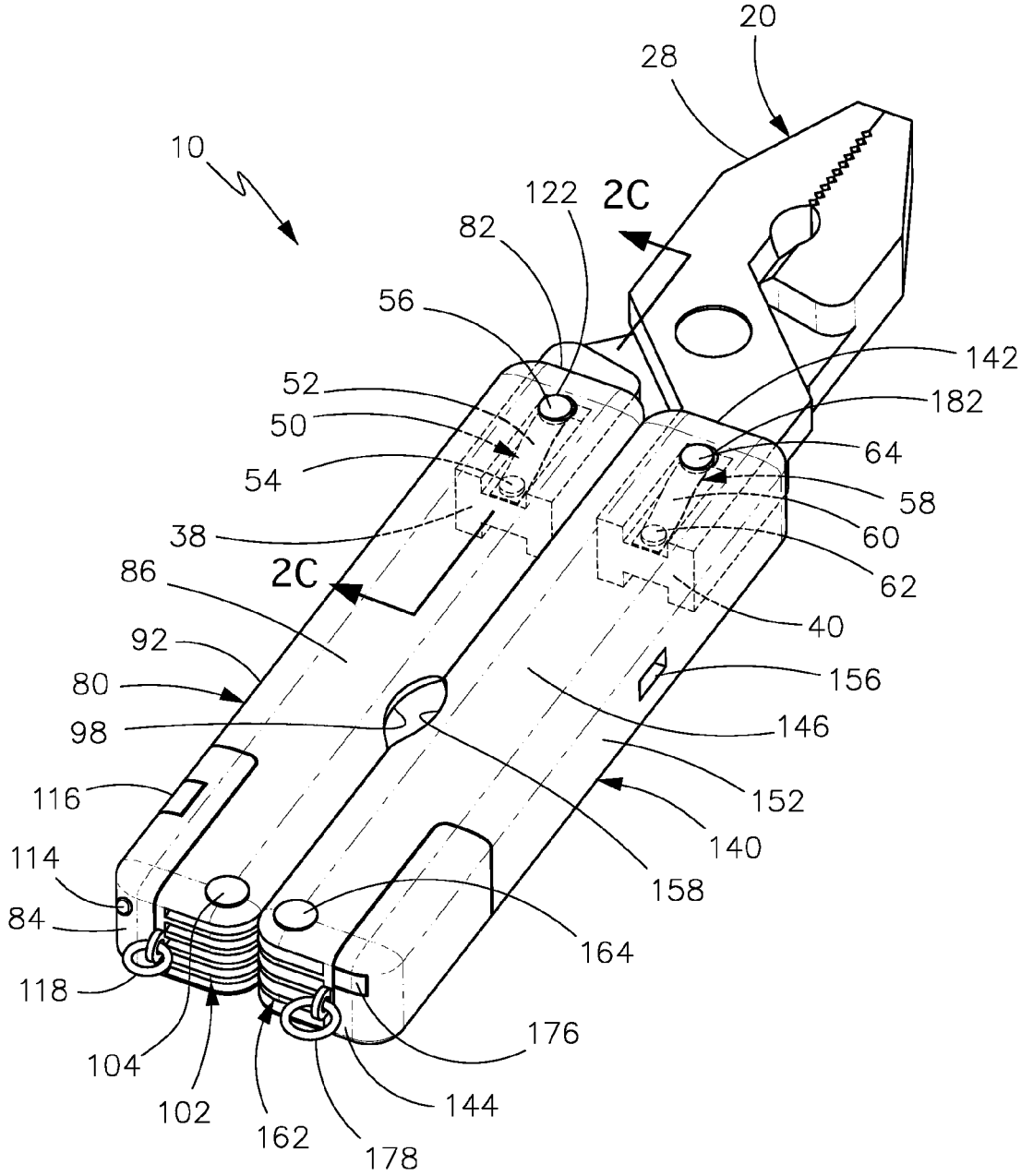
FIG. 2 is an isometric view of an interchangeable tool head mounted onto handle assemblies.

As best seen in FIG. 2, as an example locking mechanisms 50 and 58 secure proximal ends 38 and 40 of traditional pliers 28 to handle assemblies 80 and 140, whereby holes 122 and 182 have cooperative dimensions and shape to receive heads 56 and 64. Similarly, locking mechanisms 50 and 58 secure proximal ends 38 and 40 of interchangeable tool heads 22; 24; 26; 32; and 36 to handle assemblies 80 and 140, whereby holes 122 and 182 have cooperative dimensions and shape to receive heads 56 and 64. In addition, locking mechanism 50 secures proximal end 38 of interchangeable tool heads 30 and 34 to handle assembly 80 or 140, whereby holes 122 and 182 have cooperative dimensions and shape to receive head 56.

Figure 2A:
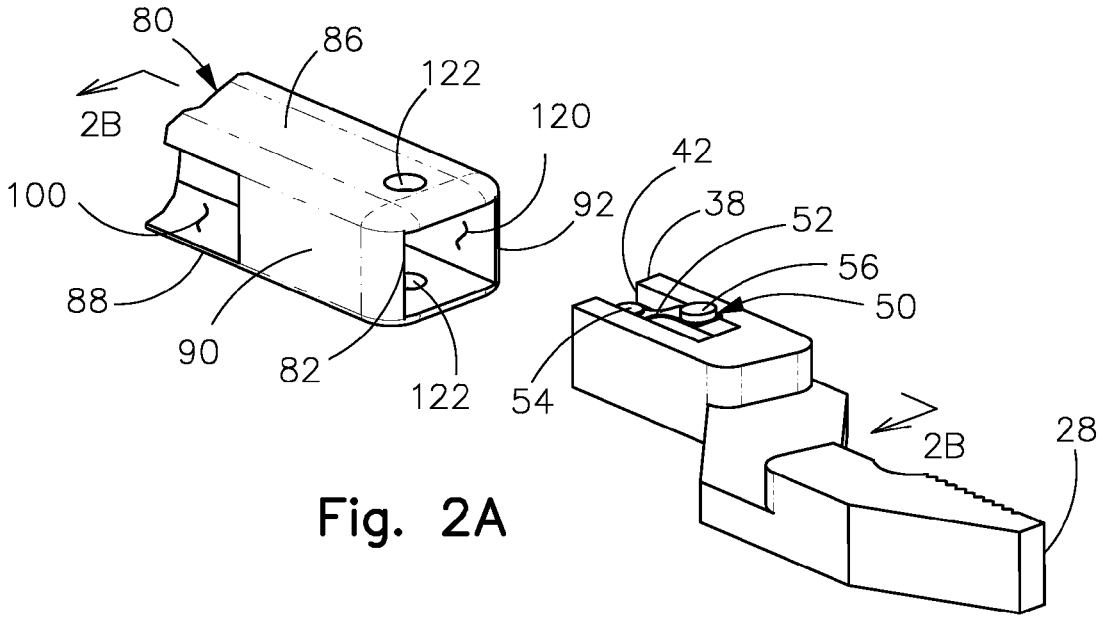
FIG. 2A is an isometric view partially illustrating a section of the interchangeable tool head assembly in position to be mounted onto a handle assembly.
Figure 2B:
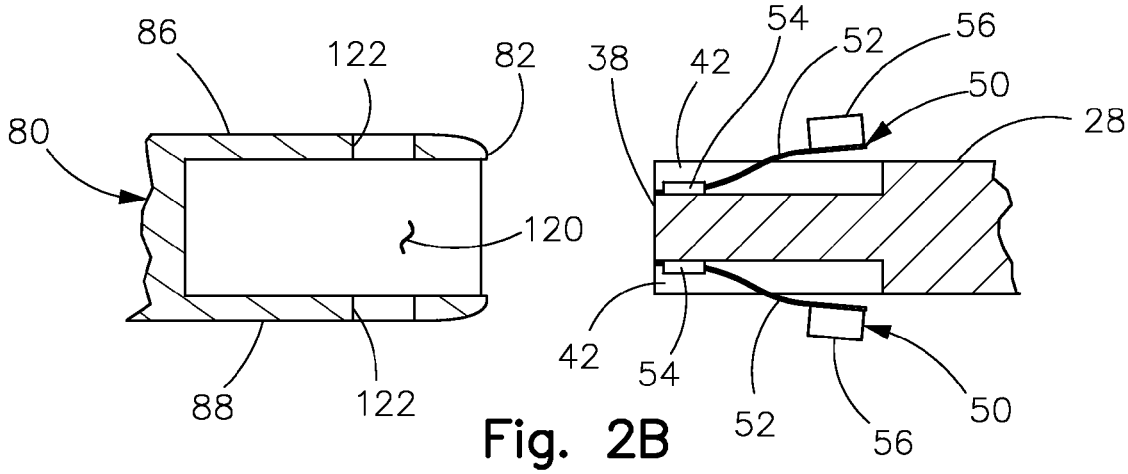
FIG. 2B is a cross-section view taken along lines 2B-2B, as seen in FIG. 2A.
Figure 2C:
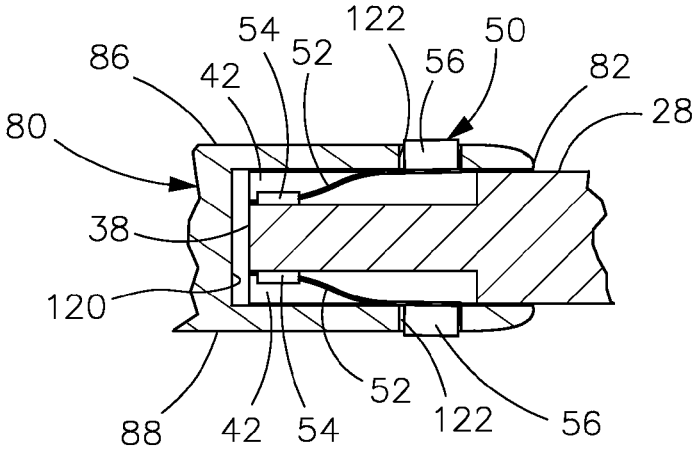
FIG. 2C is a cross-section view taken along lines 2C-2C, as seen in FIG. 2.

Seen in FIGS. 2A, 2B, and 2C is handle assembly 80. It is noted that only handle assembly 80 is illustrated for simplification, but handle assembly 140 has similar characteristics as defined below. Locking mechanisms 50 and 58 are mounted within elongated central notches 42 and 44 respectively. Locking mechanism 50 comprises metallic band 52, with base 54 at one end and head 56 at its opposite end. Each base 54 is fixed onto each respective elongated central notch 42 in a position adjacent to each proximal end 38. Metallic band 52 has resilient characteristics to urge head 56 to be kept apart from elongated central notch 42. In the same way, locking mechanism 58 comprises metallic band 60, with base 62 at one end and head 64 at its opposite end. Each base 62 is fixed to each respective elongated central notch 44 in a position adjacent to each proximal end 40. Metallic band 60 has resilient characteristics to urge head 64 to be kept apart from elongated central notch 44.

Handle assembly 80 comprises internal longitudinal channel 120 that extends from end 82. Similarly, handle assembly 140 comprises an internal longitudinal channel that extends from end 142. The internal longitudinal channels have cooperative dimensions and shape to removably receive proximal ends 38 and 40 of interchangeable tool heads 22; 24; 26; 28; 30; 32; 34; and 36. The internal longitudinal channels comprise holes 122 and 182 that extend transversally into lateral walls 86 and 88, and 146 and 148. Proximal end 38, and 40 for interchangeable tool heads having a second proximal end, have cooperative dimensions and shape to be removably received by internal longitudinal channels 120 and 180 of handle assemblies 80 and 140 respectively.

Figure 4:
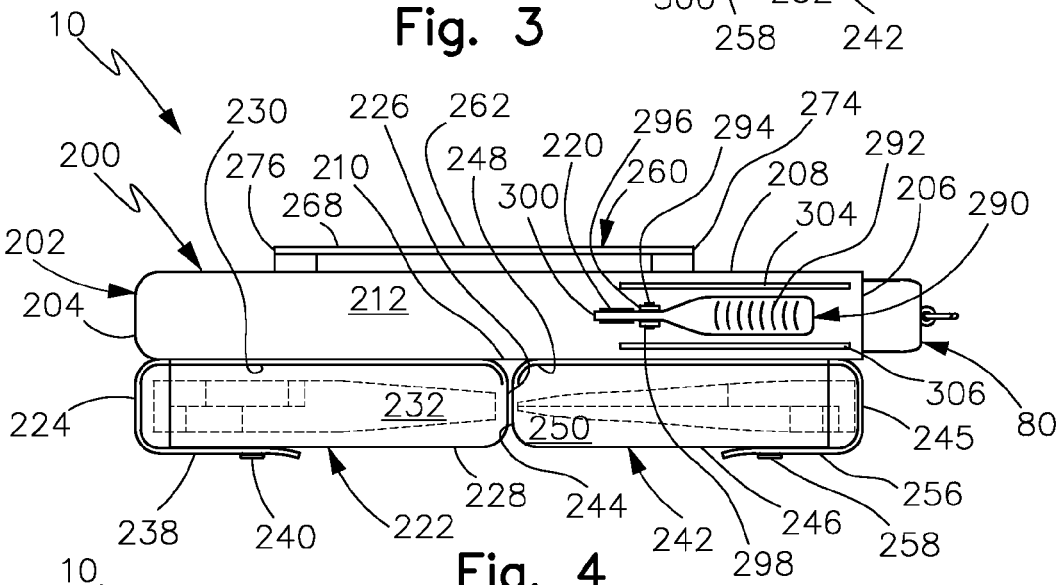
FIG. 4 is a side elevation view of the carrying case.
Figure 5:
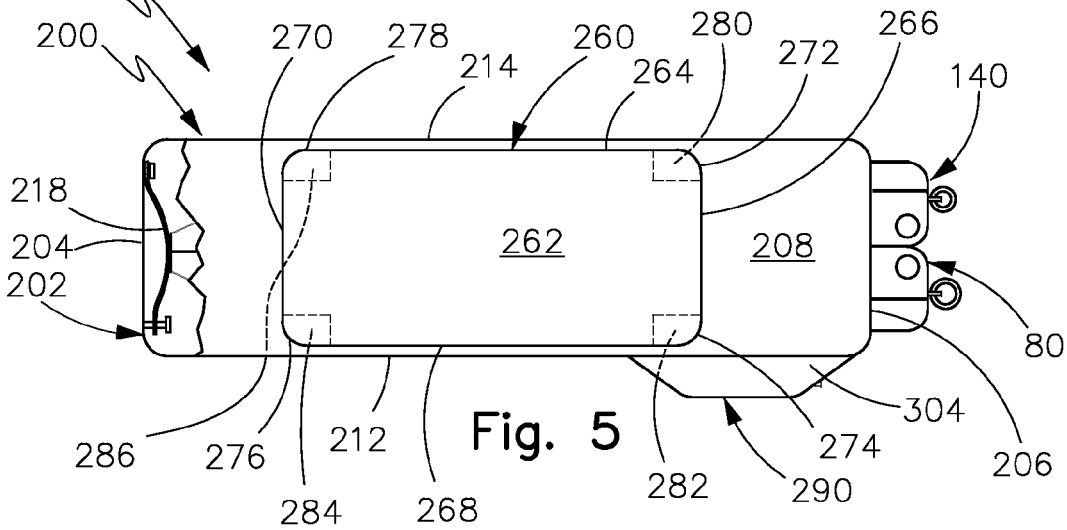
FIG. 5 is a rear view of the carrying case with a partial cross section to illustrate a leaf spring mounted therein.

As seen in FIGS. 3, 4, and 5, carrying case 200 comprises compartments 202, 222, and 242, belt clip 260, and locking mechanism 290. In the preferred embodiment, carrying case 200 is made of a semi-rigid, water-resistant material.

Compartment 202 has cooperative shape and dimensions to partially house one interchangeable tool head 22; 24; 26; 28; 30; 32; 34; or 36 while mounted onto handle assembly 80 and/or 140. Handle assemblies 80 and 140 may be kept in compartment 202 with or without an interchangeable tool head mounted thereon. Compartment 202 comprises closed end 204, open end 206, rear wall 208, intermediate wall 210, and sidewalls 212 and 214. Rear wall 208, intermediate wall 210, and sidewalls 212 and 214 define a substantially rectangular internal cavity. Leaf spring 218, best seen in FIG. 5, is mounted onto an internal surface of closed end 204. Sidewall 212 has slot 220, best seen in FIG. 4, at a predetermined distance from open end 206. Slot 220 is cooperatively aligned with oxygen bottle openers 96 and 156 when handle assemblies 80 and 140 are housed within compartment 202.

Compartment 222 comprises end walls 224 and 226, front wall 228, rear wall 230, and sidewalls 232 and 234. Compartment 222 defines an internal cavity with cooperative dimensions and shape to house one of interchangeable tool heads 22; 24; 26; 28; 30; 32; 34; or 36 therein. It is noted that edges of front wall 228, and sidewalls 232 and 234 do not reach end wall 224. End wall 224 extends toward front wall 228 to define flap 238, which is secured to front wall 228 with snap 240.

Compartment 242 comprises end walls 244 and 245, front wall 246, rear wall 248, and sidewalls 250 and 252. Compartment 242 defines an internal cavity with cooperative dimensions and shape to house one of interchangeable tool heads 22; 24; 26; 28; 30; 32; 34; or 36 therein. It is noted that edges of front wall 246, and sidewalls 250 and 252 do not reach end wall 245. End wall 245 extends toward front wall 246 to define flap 256, which is secured to front wall 246 with snap 258.

As best seen in FIGS. 4 and 5, belt clip 260 comprises sidewall 262, which is at a substantially parallel and spaced apart relationship with respect to rear wall 208. Sidewall 262 has a substantially rectangular shape, having edges 264; 266; 268; and 270, which define corners 272; 274; 276; and 278 respectively. Edges 264 and 268 are longer than edges 266 and 270. Sidewall 262 is attached to rear wall 208 with spacers 280; 282; 284; and 286 at corners 272; 274; 276; and 278 respectively. This permits a user to use belt clip 260 longitudinally or transversally as needed. Belt clip 260 also may be adjustable to accommodate different sized belts or used with other support means such as, but not limited to, suspenders, straps typically worn over the shoulders of a user to support a user's pant or trousers.

Locking mechanism 290 is mounted to sidewall 212 of compartment 202. Locking mechanism 290 comprises locking lever 292 and guard walls 304 and 306. Locking lever 292 has spring loaded pivoting pin 294, mounted to supports 296 and 298, and locking tip 300 has tab 302. Locking tip 300 passes through slot 220 and oxygen bottle opener 96, or 156 when locking mechanism 290 is in a locked position. Leaf spring 218 exerts an outward force over handle assemblies 80 and 140, thus keeping a locking effect of tip 300, inside oxygen bottle opener 96 or 156, as best seen in FIG. 3. Tab 302 prevents locking tip 300 from passing through sidewall 212 when handle assemblies 80 and 140 are not housed within compartment 202. To release locking tip 300 from handle assembly 80 or 140, the user applies a force of predetermined magnitude to locking lever 292. Guard walls 304 and 306 extend perpendicularly from sidewall 212. Guard walls 304 and 306 are at a parallel and spaced apart relationship with respect to each other and they are disposed at the lateral sides of locking lever 292 to prevent accidental release of locking mechanism 290.

Carrying case 200, especially when carrying needed tools at fire and/or emergency sites, helps prevent them from becoming lost and generally helps to have them handy without occupying hands of a user, or obstruct his/her work.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A multi-tool, comprising:

A) a head assembly having at least one interchangeable tool head with locking means, said at least one interchangeable tool head comprises spring-loaded trauma shears, a bridging head, traditional pliers, an adjustable wrench, needle-nose pliers, a ratchet, and tin snips, said at least one interchangeable tool head having a first proximal end, said spring-loaded trauma shears, said bridging head, said traditional pliers, said needle-nose pliers, and said tin snips having a second proximal end, said first and second proximal ends are in a substantial H-shape, and each comprise first and second elongated central notches;

B) a first handle assembly having first and second ends, first and second lateral walls, a first interior side, and a first exterior side, said first exterior side defining an oxygen bottle opener at a first predetermined distance from said first end without reaching said second end, said first and second lateral walls each have first and second internal edges, said first and second internal edges define first semicircular notches, said first interior side comprises a first internal channel, said first handle assembly further comprises a first at least one spring-loaded tool that is housed within said first internal channel when in a stored configuration; and C) a second handle assembly having third and fourth ends, third and fourth lateral walls, a second interior side, and a second exterior side, said second exterior side also defining said oxygen bottle opener at a second predetermined distance from said third end without reaching said fourth end, said third and fourth lateral walls each have third and fourth internal edges, said third and fourth edges define second semicircular notches, said second interior side comprises a second internal channel, said second handle assembly further comprises a second at least one spring-loaded tool that is housed within said second internal channel when in a stored configuration.

2. The multi-tool set forth in claim 1, further characterized in that said first at least one spring-loaded tool comprises a pendulum/swivel key, a half moon key, a T-way key, and a window punch.

3. The multi-tool set forth in claim 1, further characterized in that said first at least one spring-loaded tool are disposed in a parallel and spaced apart relationship with respect to each other and with respect to said first and second lateral walls.

4. The multi-tool set forth in claim 1, further comprising a light-emitting diode internally mounted under said first lateral wall, adjacent to said first end.

5. The multi-tool set forth in claim 4, further characterized in that said light-emitting diode is battery powered and is controlled by a switch.

6. The multi-tool set forth in claim 1, further comprising a key ring secured onto said first end.

7. The multi-tool set forth in claim 1, further characterized in that said second at least one spring-loaded tool comprises an Allen wrench, a knife with serrated edge that has a bottle cap opener, a flat head screw driver with seat belt/fabric cutter, a Phillips screw driver, and metal cutting blade.

8. The multi-tool set forth in claim 1, further characterized in that said second at least one spring-loaded tool are disposed in a parallel and spaced apart relationship with respect to each other and with respect to said third and fourth lateral walls.

9. The multi-tool set forth in claim 1, further comprising an alternating current detector internally mounted under said third lateral wall, adjacent to said third end and said second exterior side.

10. The multi-tool set forth in claim 1, further comprising a key ring secured onto said third end.

11. The multi-tool set forth in claim 1, further characterized in that said first and second handle assemblies comprise first and second internal longitudinal channels defined from said second and fourth ends respectively, said first and second internal longitudinal channels are of cooperative shape and dimensions to receive said first and second proximal ends.

12. The multi-tool set forth in claim 11, further characterized in that said locking means comprises said first and second elongated central notches each having at least one metallic band with a base at a fifth end and a head at a sixth end, said base is fixed onto said first and second elongated central notches, said at least one metallic band has resilient characteristics to urge said head to be kept apart from each of said first and second elongated central notches, and said head fits into a through hole of said first and second handle assemblies.

13. The multi-tool set forth in claim 1, further comprising a carrying case to carry said head assembly having at least one interchangeable tool head with locking means, said first handle assembly, and said second handle assembly, said carrying case comprises a first compartment having a locking mechanism.

14. The multi-tool set forth in claim 13, further characterized in that said locking mechanism comprises a locking lever and first and second guard walls, said locking lever has a spring loaded pivoting pin that is mounted onto first and second supports, and a locking tip having a tab, said locking mechanism further comprises a leaf spring that exerts an outward force over said first and second handle assemblies.

15. The multi-tool set forth in claim 14, further characterized in that a predetermined force is applied upon said locking lever to release said locking tip from said first and second handle assemblies.

16. The multi-tool set forth in claim 15, further characterized in that at least a second compartment mounts upon said first compartment to house said at least one interchangeable tool head.

* * * * *